US009490572B2

(12) United States Patent
Neumann-Henneberg

(10) Patent No.: US 9,490,572 B2
(45) Date of Patent: Nov. 8, 2016

(54) ELECTRICAL PLUG CONNECTOR

(71) Applicant: Wolf Neumann-Henneberg, Rietheim-Weilheim (DE)

(72) Inventor: Wolf Neumann-Henneberg, Rietheim-Weilheim (DE)

( * ) Notice: Subject to any disclaimer, the term of this patent is extended or adjusted under 35 U.S.C. 154(b) by 0 days.

(21) Appl. No.: 14/823,583

(22) Filed: Aug. 11, 2015

(65) Prior Publication Data

US 2016/0111812 A1 Apr. 21, 2016

(30) Foreign Application Priority Data

Oct. 16, 2014 (EP) ..... 14189206

(51) Int. Cl.

*H01R 13/533* (2006.01)
*H01R 4/62* (2006.01)
*H01R 13/187* (2006.01)
*H01R 101/00* (2006.01)

(52) U.S. Cl.

CPC ..... *H01R 13/533* (2013.01); *H01R 4/62* (2013.01); *H01R 13/187* (2013.01); *H01R 2101/00* (2013.01)

(58) Field of Classification Search

USPC ..... 439/519, 884, 668, 842, 843, 857, 559, 439/801

See application file for complete search history.

(56) References Cited

U.S. PATENT DOCUMENTS 4,714,441 A * 12/1987 Corman ..... H01R 13/187 439/842
4,960,391 A * 10/1990 Beinhaur ..... H01B 17/305 174/152 GM
5,769,671 A * 6/1998 Lim ..... H01R 13/187 439/843
7,355,500 B2 * 4/2008 Vom Schloss ..... F02P 13/00 336/192
7,556,540 B2 * 7/2009 Siebens ..... H01R 13/53 439/801
7,575,462 B2 * 8/2009 Macey ..... B60D 1/64 439/352
8,483,530 B2 * 7/2013 Sorensen ..... H01R 13/523 385/111
8,579,653 B2 * 11/2013 Neumann-Henneberg ..... H01R 13/187 439/469
8,761,887 B2 * 6/2014 Schramm ..... A61N 1/3752 607/37
8,894,448 B2 * 11/2014 Affeltranger ..... H01R 4/2433 439/701
2008/0160833 A1 * 7/2008 Shipalesky ..... E21B 17/026 439/625
2015/0111443 A1 * 4/2015 Gutenschwager ... H01R 13/187 439/884

FOREIGN PATENT DOCUMENTS

DE 623128 12/1935
EP 2595250 B1 1/2014
GB 1111344 A 4/1968
JP 2011165618 A 8/2011

* cited by examiner

*Primary Examiner* — Alexander Gilman
(74) *Attorney, Agent, or Firm* — Von Rohrscheidt Patents

(57) ABSTRACT

The invention relates to an electrical plug connector including a plug and a coupling in which radially spring elastic annular contact lamellas are arranged. In order to prevent corrosion when the plug and the coupling are made from different materials the invention proposes a tin plated bushing in the coupling in which bushing the contact lamellas are arranged.

8 Claims, 2 Drawing Sheets

ELECTRICAL PLUG CONNECTOR

RELATED APPLICATIONS

This application claims priority from and incorporates by reference European patent application 14 189 206.7 filed on Oct. 16, 2014.

FIELD OF THE INVENTION

The invention relates to an electrical plug connector with the features of the preamble of claim 1. The invention is particularly advantageous for disengageable electrical connections for high currents of up to several hundred amperes, for example in electrical vehicles or in hybrid vehicles. The plug connector is also useable in lieu of cable terminals or threaded connections.

BACKGROUND OF THE INVENTION

Due to electrical resistance and resulting electrical losses and heating electrically well conductive metals like copper and copper alloys or aluminium and aluminium alloys are used for electrical conductors and plug connectors. However, when conductors including aluminium and copper are connected corrosion is to be expected due to the different electrochemical potential. In order to exclude corrosion moisture at contact locations has to be excluded under all operating conditions which requires special cable terminals and diligent and complex procedures. When different metals come in contact there is a corrosion problem as a matter of principle.

U.S. Pat. No. 5,769,671 discloses a sleeve shaped coupling for an electrical plug connector in which a diamond shaped spring clamp is arranged. The spring clamp is elastic in a radial direction and includes bead shaped inward oriented protrusions at longitudinal centers of its sides for contacting an inserted plug. The known coupling is not well suited for high currents and it is certainly unsuited for different metals.

The German patent DE 623 128 discloses an electrical plug connector with a pin shaped plug and a sleeve shaped coupling which envelops the inserted plug with an annular cavity in between, in the interior cavity a stack of flat contact elements is arranged which are shaped as washers which have circular arc shaped spring arms which are integrally provided in one piece with the contact elements and which envelop the washers with a gap there between. The washers are not coaxially arranged in the coupling but they have alternating offsets in opposite directions wherein the offsets, however, are small enough so that the holes of the washers overlap far enough so that the pin shaped plug can be inserted. This plug connector is also unsuitable for different metals.

The European patent EP 2 595 250 B1 also includes an electrical plug connector with a pin shaped plug and a sleeve shaped coupling which envelops the inserted plug with a gap there between. In the gap annular contact elements are arranged which are open at one location of its circumference, wherein the contact elements are spring elastic in radial direction and contact the coupling and the plug when the plug is inserted so that the contact elements connect the plug and the coupling in an electrically conducting manner. This plug connector is suitable for high currents, but it is not suitable for different metals.

BRIEF SUMMARY OF THE INVENTION

Thus, it is an object of the invention to propose a low resistance electrical plug connector, whose plug and coupling are made from different metals with different electrochemical potentials.

This object is achieved according to the invention by an electrical plug connector, including a pin shaped plug; a sleeve shaped coupling enveloping the plug with a gap in an inserted condition; and an electrically conductive contact element arranged in the gap and configured as a ring, wherein the electrically conductive contact element is spring elastic transversal to a plug-in direction and contacts the plug in the inserted condition and electrically connects the plug and the coupling, wherein the plug and the coupling are made from different metals, wherein a bushing made from metal is arranged between the coupling and the contact element, and wherein the contact element contacts the bushing which is in electrically conductive contact with the coupling and which includes a corrosion protection layer.

The electrical plug connector according to the invention includes a pin shaped plug and a sleeve shaped coupling which envelops the inserted plug with a gap there between. An electrically conductive annular contact element is arranged in the intermediary gap, wherein the contact element is spring elastic transversal to an insertion direction and connects the inserted plug with the coupling in an electrically conductive manner. Thus, the plug and the coupling are made from different metals. In the plug connector according to the invention the contact element and the coupling are not in direct contact with each other but a metal bushing is arranged between the contact element and the coupling wherein the contact element contacts the bushing internally so that it is electrically connected with the bushing. In addition to being in electrical contact with the contact element the bushing is in electrical contact with the coupling so that the contact element is electrically connected with the coupling of the plug connector through the bushing. In order to prevent corrosion with different metals the bushing has a corrosion protection layer for example made from tin. The corrosion protection layer is provided at least on the surfaces which are in contact with the contact element and/or the coupling. When the coupling is made from the same metal as the contact element or the coupling the bushing does not have to have a corrosion protection layer at this location. The corrosion protection layer can also cover all surfaces of the bushing. The bushing is made for example from copper or a copper alloy and/or is tin plated in a galvanic manner. The corrosion protection layer of the bushing prevents corrosion due to different electrochemical potentials of different metals of the coupling and of the contact element.

In order to reduce an electrical resistance of the plug connector and in order to increase current conducting capability one embodiment provides plural contact elements that are arranged in a stack.

One embodiment of the invention provides that the plug and/or the at least one contact element are made from the same metal or at least from metals with identical electrode potential. In this embodiment of the invention there is no electrochemical potential between the plug and/or the at least one contact element. For example the plug and/or the at least one contact element is made from copper or a copper alloy, wherein the plug and the at least one contact element can be made from different copper alloys. It is essential that they have the same electrode potential, this means the same electrochemical potential so that contacting does not generate an electrical voltage which would cause erosion in the presence of humidity.

An embodiment of the invention provides that a corrosion protection element is arranged between the plug and the coupling on one side of the contact element or on both sides of the contact element or of a stack of contact elements. The corrosion protection element can be made for example from an electrically insulating material, for example a plastic material or it is made from metal and has a corrosion protection layer. The contact element prevents direct contact between the plug and the coupling of the electrical plug connector so that there is no corrosion due to the different electrode potential of plug and coupling.

One embodiment of the invention provides that the plug of the electrical plug connector is made from copper or a copper alloy and the coupling is made from aluminum or an aluminum alloy. Inverting this material selection or selecting other materials is quite feasible.

In an advantageous embodiment of the invention the coupling of the electrical plug connector is shrunk onto the bushing which is arranged between the contact element and the coupling. The coupling is heated and/or the bushing is cooled before the bushing is introduced into the coupling so that the bushing can be introduced into the coupling with little friction and damaging the corrosion protection layer is prevented. The shrink fit does not have to have a high level of mechanical support. It is essential that the corrosion protection layer is not damaged during assembly.

An embodiment of the invention provides that the coupling includes a support sleeve which envelops the coupling in the portion in which the at least one contact element is arranged. The support sleeve supports the coupling from outside against expansion. Advantageously the support sleeve is pressed onto the coupling and has a preload. The support sleeve prevents an expansion of the coupling of the electrical plug connector according to the invention caused by relaxation of the bushing onto which the coupling is shrunk. The support sleeve is made for example from stainless steel, has a corrosion protection layer or it is made from an electrically insulating material. The support sleeve is provided in particular for a coupling that is made from aluminum or an aluminum alloy where there is a risk of relaxation. A coupling made from aluminum or an aluminum alloy provides a plug connection for an electrical conductor which is made from aluminum or an aluminum alloy and therefore connectable to a coupling made from aluminum or an aluminum alloy without having a difference in potential. When there are high contact forces between plug and coupling the support sleeve prevents a relaxation of the coupling and thus a reduction of the contact forces. The support sleeve also prevents a relaxation of the coupling and a reduction of the contact forces between plug and coupling caused by temperature influences.

BRIEF DESCRIPTION OF THE DRAWINGS

The invention is subsequently described based on an embodiment with reference to drawing figures, wherein.

DETAILED DESCRIPTION OF THE INVENTION

Figure 1:
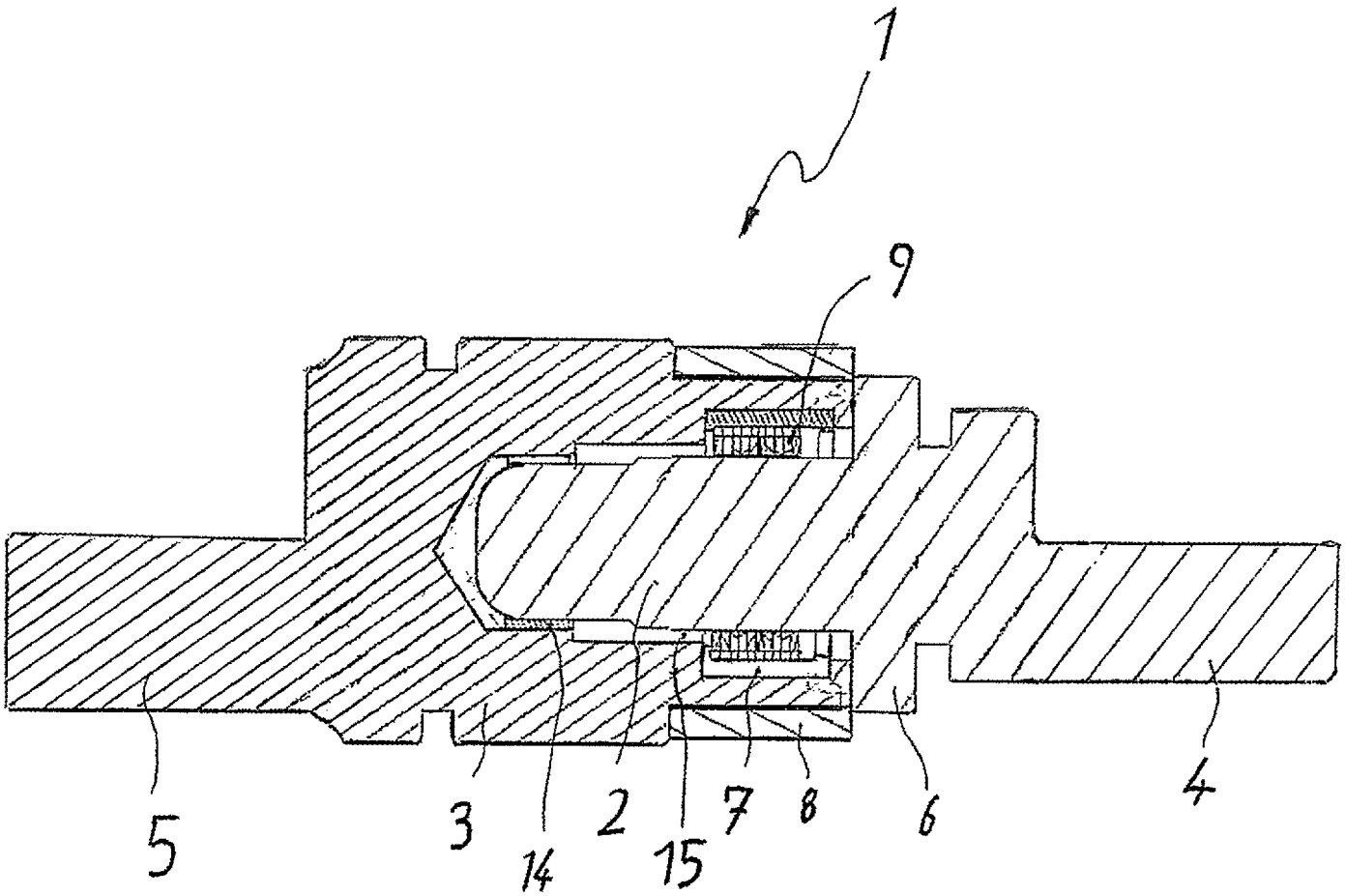
FIG. 1 illustrates an axial sectional view of an electrical plug connector according to the invention.

The electrical plug connector 1 illustrated in FIG. 1 includes a pin shaped plug 2 and a sleeve shaped coupling 3. The plug 2 is made from a copper alloy, the coupling 3 is made from an aluminum alloy. The plug 2 and also the coupling 3 have flattened tongue shaped connectors 4, 5 for attaching cables that are not illustrated, for example by welding. The plug 2 includes a flange 6 which contacts a face edge of the coupling 3 when the plug 2 is completely inserted into the coupling 3. The flange 6 limits an insertion depth of the plug 2 into the coupling 3.

A longitudinally slotted bushing 7 is arranged in the coupling 3 in a section that is adjacent to an outlet. The bushing 7 is made from a copper alloy and includes a galvanically deposited tin layer forming a corrosion protection layer on all its surfaces, wherein the tin layer prevents corrosion with a coupling 3 of the plug connector 1 which coupling is made from an aluminum alloy. In order to prevent damaging the corrosion protection layer the coupling 3 is heated to a temperature of 85° C. or more for inserting the bushing 7 into the coupling 3 and optionally the bushing 7 is cooled below ambient temperature, for example minus 85° C. so that the bushing 7 is easily insertable into the coupling 3 and the corrosion protection layer is not damaged. After the temperatures have equalized the bushing 7 is seated sufficiently tight in the coupling 3. Cooling the bushing 7 during insertion into the coupling, for example to −85° C. anticipates an expected operating temperature so that the bushing 7 does not come loose when the coupling is exposed to a respectively low temperature.

The coupling 3 has a support sleeve 8 made from stainless steel in the portion where the bushing 7 is arranged. Before insertion of the bushing 7 the support sleeve 8 is pressed onto the coupling 3 and envelops the coupling 3 with a preload so that the coupling 3 made from an aluminum alloy is not expanded by an internally acting pressure of the bushing 7.

Figure 2:
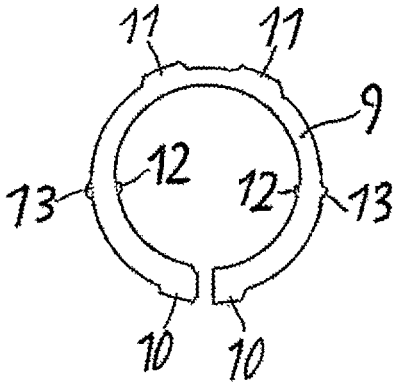
FIG. 2 illustrates a view of a contact element of the plug connector according to FIG. 1.

A plurality of stacked contact lamellas which are shaped annular and which are open at a circumferential location are arranged in the bushing 7 to form contact elements 9. One of the contact elements 9 is illustrated in FIG. 2. The contact elements 9 are almost circular slightly flattened and as stated supra they are open at a circumferential location. The contact elements 9 have outward extending protrusions 10 on both sides of the open circumferential location and two additional outward extending protrusions 11 opposite to the protrusions 10, wherein the protrusions 11 contact the bushing 7 internally under an elastic preload. The contact elements 9 are thus in electrically conducting contact with the bushing 7 which is in turn in electrically conductive contact with the coupling 3. Approximately in a center of semi arcs between the protrusions 10, 11 the contact elements 9 include inward extending protrusions and outward extending protrusions 12, 13. The inward extending protrusions 12 contact the plug 2 under an elastic preload when the plug 2 is inserted, so that an electrically conductive contact is provided between the plug 2 and the contact elements 9, wherein the contact elements 9 are in turn electrically connected with the coupling 3 through the bushing 7. The outward extending protrusions 13 protect the contact elements 9 against damage through plastic deformation through overload. The protrusions 12, 13 can also be arranged at other locations or internally and can be externally offset in circumferential direction at the contact elements 9 which is not illustrated. The contact elements 9 are spring elastic in radial direction. Providing a plurality of contact elements 9 achieves a low electrical transition resistance between the plug 2 and the coupling 3. The contact elements 9 are stamped from sheet metal, they are made from a copper alloy like the plug 2 so that they have the same electrode potential as the plug 2 so that there is no electrochemical voltage which prevents corrosion.

A corrosion protection element 14 is arranged at a base of the coupling 3 wherein a front end of the plug 2 is arranged in the corrosion protection element when the plug 2 is inserted into the coupling 3 until its flange 6 contacts a face of the coupling 3. The corrosion protection element 14 is a longitudinally slotted sleeve. The corrosion protection element 14 is made from a copper alloy and is galvanically tin plated like the bushing 7 in order to form a corrosion protection layer. The corrosion protection element 14 prevents direct contact between the plug 2 and the coupling 3 and prevents corrosion through its corrosion protection layer.

The cited materials are not required to practice the invention. Other materials and material pairings are feasible.

What is claimed is:

1. An electrical plug connector, comprising:

a pin shaped plug;

a sleeve shaped coupling enveloping the plug with a gap in an inserted condition; and at least one electrically conductive contact element arranged in the gap and configured as a ring, wherein the at least one electrically conductive contact element is spring elastic transversal to a plug-in direction and contacts the plug in the inserted condition and electrically connects the plug and the coupling, wherein the plug and the coupling are made from different metals, wherein a bushing made from metal is arranged between the coupling and the contact element, and wherein the at least one electrically conductive contact element contacts the bushing which is in electrically conductive contact with the coupling and which includes a corrosion protection layer.

2. The electrical plug connector according to claim 1, wherein the electrical plug connector includes plural stacked electrically conductive contact elements.

3. The electrical plug connector according to claim 1, wherein the plug and the at least one electrically conductive contact element have a different electrode potential.

4. The electrical plug connector according to claim 1, wherein a corrosion protection element is arranged on one side of the contact element between the plug and the coupling.

5. The electrical plug connector according to claim 1, wherein the plug is made from copper or from a copper alloy or the coupling is made from aluminium or an aluminium alloy.

6. The electrical plug connector according to claim 1, wherein the plug is made from copper or from a copper alloy and the coupling is made from aluminium or an aluminium alloy.

7. An electrical plug connector, comprising:

a pin shaped plug;

a sleeve shaped coupling enveloping the plug with a gap in an inserted condition; and at least one electrically conductive contact element arranged in the gap and configured as a ring, wherein the at least one electrically conductive contact element is spring elastic transversal to a plug-in direction and contacts the plug in the inserted condition and electrically connects the plug and the coupling, wherein the plug and the coupling are made from different metals, wherein a bushing made from metal is arranged between the coupling and the contact element, and wherein the at least one electrically conductive contact element contacts the bushing which is in electrically conductive contact with the coupling and which includes a corrosion protection layer, and wherein the coupling is shrunk onto the bushing.

8. An electrical plug connector, comprising:

a pin shaped plug:

a sleeve shaped coupling enveloping the plug with a gap in an inserted condition; and at least one electrically conductive contact element arranged in the gap and configured as a ring, wherein the at least one electrically conductive contact element is spring elastic transversal to a plug-in direction and contacts the plug in the inserted condition and electrically connects the plug and the coupling, wherein the plug and the coupling are made from different metals, wherein a bushing made from metal is arranged between the coupling and the contact element, and wherein the at least one electrically conductive contact element contacts the bushing which is in electrically conductive contact with the coupling and which includes a corrosion protection layer, and wherein the coupling has a support sleeve which envelops the coupling in a portion of the bushing and which supports the coupling against an expansion.

* * * * *